US010682556B2

(12) United States Patent
Simone

(10) Patent No.: US 10,682,556 B2
(45) **Date of Patent: *Jun. 16, 2020**

(54) GOLF CLUB HEADS HAVING A HYDROPHOBIC SURFACE AND METHODS TO MANUFACTURE GOLF CLUB HEADS HAVING A HYDROPHOBIC SURFACE

(71) Applicant: Karsten Manufacturing Corporation, Phoenix, AZ (US)

(72) Inventor: Matthew W. Simone, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/367,123

(22) Filed: Mar. 27, 2019

(65) Prior Publication Data

US 2019/0217164 A1 Jul. 18, 2019

Related U.S. Application Data

(63) Continuation of application No. 15/958,709, filed on Apr. 20, 2018, now Pat. No. 10,279,227, which is a continuation of application No. 15/586,090, filed on May 3, 2017, now Pat. No. 9,975,017, which is a continuation of application No. 14/323,347, filed on Jul. 3, 2014, now Pat. No. 9,737,771.

(60) Provisional application No. 61/847,784, filed on Jul. 18, 2013.

(51) Int. Cl.
*A63B 53/04* (2015.01)

(52) U.S. Cl.
CPC ..... *A63B 53/047* (2013.01); *A63B 53/04* (2013.01); *A63B 53/0466* (2013.01); *A63B 53/0487* (2013.01); *A63B 2053/0408* (2013.01); *A63B 2053/0416* (2013.01); *A63B 2053/0445* (2013.01)

(58) Field of Classification Search
CPC .... A63B 2053/0445; A63B 2053/0408; A63B 2053/0416; A63B 53/04; A63B 53/047; A63B 53/0466; A63B 53/0487
USPC ..... 473/330, 331, 332, 342
See application file for complete search history.

(56) References Cited

U.S. PATENT DOCUMENTS

| | | | | |
|---|---|---|---|---|
| 4,768,787 | A | 9/1988 | Shira | |
| 6,224,497 | B1 * | 5/2001 | Antonious | A63B 53/04 473/330 |
| 7,179,175 | B2 | 2/2007 | Kennedy, III | |
| 7,278,928 | B2 | 10/2007 | Newman et al. | |
| 7,445,561 | B2 | 11/2008 | Newman et al. | |
| 7,901,297 | B2 | 3/2011 | Ban et al. | |

(Continued)

*Primary Examiner* — Benjamin Layno

(57) ABSTRACT

Embodiments of golf club heads having a hydrophobic surface and methods to manufacture such golf club heads are generally described herein. The golf club heads are configured to comprise a ball-striking face and at least two channels formed therein. The channels are separated by a land portion of the ball-striking face extending therebetween. The land portion is associated with at least a first step portion extending at a first elevation and a second step portion extending at a second elevation, the second elevation being higher than the first elevation relative to a bottom of the channels. Each of the first and second step portions is so dimensioned as to be associated with a substantially hydrophobic contact angle.

19 Claims, 4 Drawing Sheets

(56) References Cited

U.S. PATENT DOCUMENTS

| | | | | |
|---|---|---|---|---|
| 7,976,404 | B2 | 7/2011 | Golden et al. | |
| 8,128,511 | B2 | 3/2012 | Golden et al. | |
| 8,147,352 | B2 | 4/2012 | Lee et al. | |
| 8,617,002 | B2 | 12/2013 | Rick | |
| 9,737,771 | B2 | 8/2017 | Simone | |
| 10,279,227 | B2 * | 5/2019 | Simone | A63B 53/047 |
| 2010/0331107 | A1 | 12/2010 | Rick | |
| 2011/0111883 | A1 | 5/2011 | Cackett | |
| 2011/0269568 | A1 | 11/2011 | Ban | |
| 2011/0300967 | A1 | 12/2011 | Ban | |
| 2012/0071269 | A1 | 3/2012 | Rahrig | |
| 2012/0157228 | A1 | 6/2012 | Lee et al. | |
| 2013/0053171 | A1 | 2/2013 | Carlyle et al. | |

* cited by examiner

GOLF CLUB HEADS HAVING A HYDROPHOBIC SURFACE AND METHODS TO MANUFACTURE GOLF CLUB HEADS HAVING A HYDROPHOBIC SURFACE

CROSS-REFERENCE TO RELATED APPLICATIONS

This is a continuation of U.S. patent application Ser. No. 15/958,709 filed Apr. 20, 2018, now U.S. Pat. No. 10,279,227 which is a continuation of U.S. patent application Ser. No. 15/586,090 filed May 3, 2017, now U.S. Pat. No. 9,975,017 issued May 22, 2018, which is a continuation of U.S. patent application Ser. No. 14/323,347 filed Jul. 3, 2014, now U.S. Pat. No. 9,737,771 issued Aug. 22, 2017, which claims priority to U.S. Patent Provisional Application No. 61/847,784, filed on Jul. 18, 2013, the content of all of which are fully incorporated herein by reference.

FIELD

The present disclosure relates to a club head having a hydrophobic surface, and in particular a golf club head.

BACKGROUND

In several types of sports, such as golf, hockey, baseball, softball, tee ball, and cricket, an individual may use a club with a ball-striking face to strike an object such as a ball. For each sport, a variety of clubs may be used. In particular, golf clubs may include a driver-type golf club, a fairway wood-type golf club, a hybrid-type golf club, an iron-type golf club, a wedge-type golf club, and a putter-type golf club.

During early morning rounds or on rainy days when the grass is wet, the golf club head may become wet by contacting the wet grass on the ground. In particular, water may be located between grooves on the ball-striking force. However, water or moisture between the ball and the golf club head may affect the spin of the ball, particularly in higher lofted iron-type golf clubs and wedge-type golf clubs. For enhancing the performance of the golf clubs, a hydrophobic or water-repellant surface on a club head may be desirable. By repelling water to the grooves of the club head, the golf clubs may facilitate reducing variability between dry and wet conditions, e.g., for imparting spin to the ball. Moreover, by repelling water to the grooves, corrosion of the club head may be mitigated.

BRIEF DESCRIPTION OF THE DRAWINGS

Corresponding reference characters indicate corresponding elements among the various views of the drawings. The headings used in the figures should not be interpreted to limit the scope of the claims.

DESCRIPTION

As described herein, golf club heads are configured to comprise a hydrophobic ball-striking face and at least two channels formed therein. The channels are separated by a land portion of the ball-striking face extending therebetween. The land portion is associated with at least a first step portion extending at a first elevation and a second step portion extending at a second elevation, the second elevation being higher than the first elevation relative to a bottom of the channels. Each step portion is so dimensioned as to be associated with a substantially hydrophobic contact angle. The first and second step portions of the land portion extending between the channels may facilitate repelling water to the channels so as to reduce variability between dry and wet conditions. In some embodiments, each step portion may be substantially free of a polymer coating.

Figure 1:
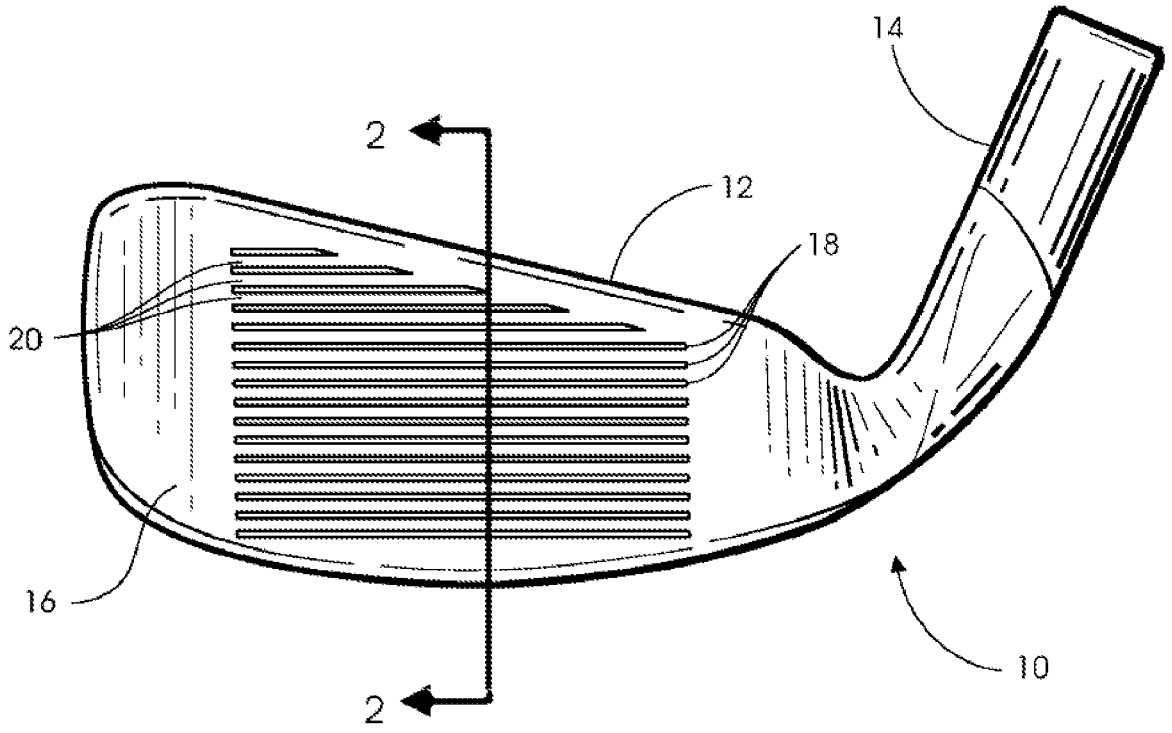
FIG. 1 is an end view of a golf club head according to one embodiment of the apparatus, methods, and articles of manufacture described herein.

Referring to FIG. 1, for example, a golf club 10 comprises a golf club head 12 and a shaft 14 coupled thereto. The golf club head 12 includes a ball-striking face 16 that is configured and adapted for impacting a golf ball (not shown). In some embodiments, the ball-striking face 16 may comprise at least one of an aluminum alloy, a stainless steel, a carbon steel, a titanium alloy, a copper alloy, a nickel alloy, a magnesium alloy, an amorphous alloy, a composite material, or any combination thereof.

In some embodiments, the aluminum alloys may be commonly grouped according to their chemical compositions into the following alloy designation series: a 1000 series aluminum alloy, a 2000 series aluminum alloy, a 3000 series aluminum alloy, a 4000 series aluminum alloy, a 5000 series aluminum alloy, a 6000 series aluminum alloy, and a 7000 series aluminum alloy. A 1000 series aluminum alloy may contain aluminum of 99.00% or higher purity. A 2000 series aluminum alloy may contain copper as the principal alloying element, often with magnesium as a secondary addition. A 3000 series aluminum alloy may contain manganese as the major alloying element. A 4000 series aluminum alloy may contain silicon as the major alloying element. A 5000 series aluminum alloy may contain magnesium as the major alloying element. A 6000 series aluminum alloy may contain silicon and magnesium. A 7000 series aluminum alloy may contain zinc as the major alloying element. The apparatus, methods, and articles of manufacture described herein are not limited in this regard.

In some embodiments, the titanium alloys may comprise by weight, about 5.50% to about 6.75% aluminum, about 3.5% to about 4.5% vanadium, and the balance titanium and incidental elements and impurities. In other embodiments, the titanium alloys may comprise, by weight, about 5.5% to about 6.5% aluminum, about 1.8% to about 2.2% tin, about 3.6% to about 4.4% zirconium, about 1.8% to about 2.2% molybdenum, and the balance titanium and incidental elements and impurities. In still other embodiments, the ball-striking face 16 may be made from other materials. The apparatus, methods, and articles of manufacture described herein are not limited in this regard.

The ball-striking face 16 of the golf club head 12 includes at least two channels, grooves, or score lines 18 formed therein. Although in the illustrated embodiment each channel 18 roughly resembles a isosceles trapezoid in cross section, in other embodiments one or more channels 18 may assume any other geometric form. The channels 18 are separated by a land portion 20 of the ball-striking face 16 extending therebetween. In some embodiments, each channel 18 may be associated with a width of approximately 0.76 mm or 0.030 inches, and a depth or height of approximately 0.46 mm or 0.018 inches. In other embodiments, the channels 18 may be associated with widths and depths of other dimensions. The apparatus, methods, and articles of manufacture described herein are not limited in this regard.

Although the illustrated golf club 10 is a wedge-type golf club, in other embodiments, the golf club 10 may be any other types of golf clubs. For example, in some embodiments, the golf club 10 may be a driver-type golf club, a fairway-wood-type golf club, an iron-type golf club, a hybrid-type golf club, or a putter-type golf club. It should be noted that some embodiments disclosed herein may conform to rules and/or standards of golf defined by various golf standard organizations, governing bodies, and/or rule establishing entities such as the United States Golf Association (USGA) and the Royal and Ancient Golf Club of St. Andrews (R&A), but the apparatus, methods, and articles of manufacture described herein are not limited in this regard.

Figure 2:
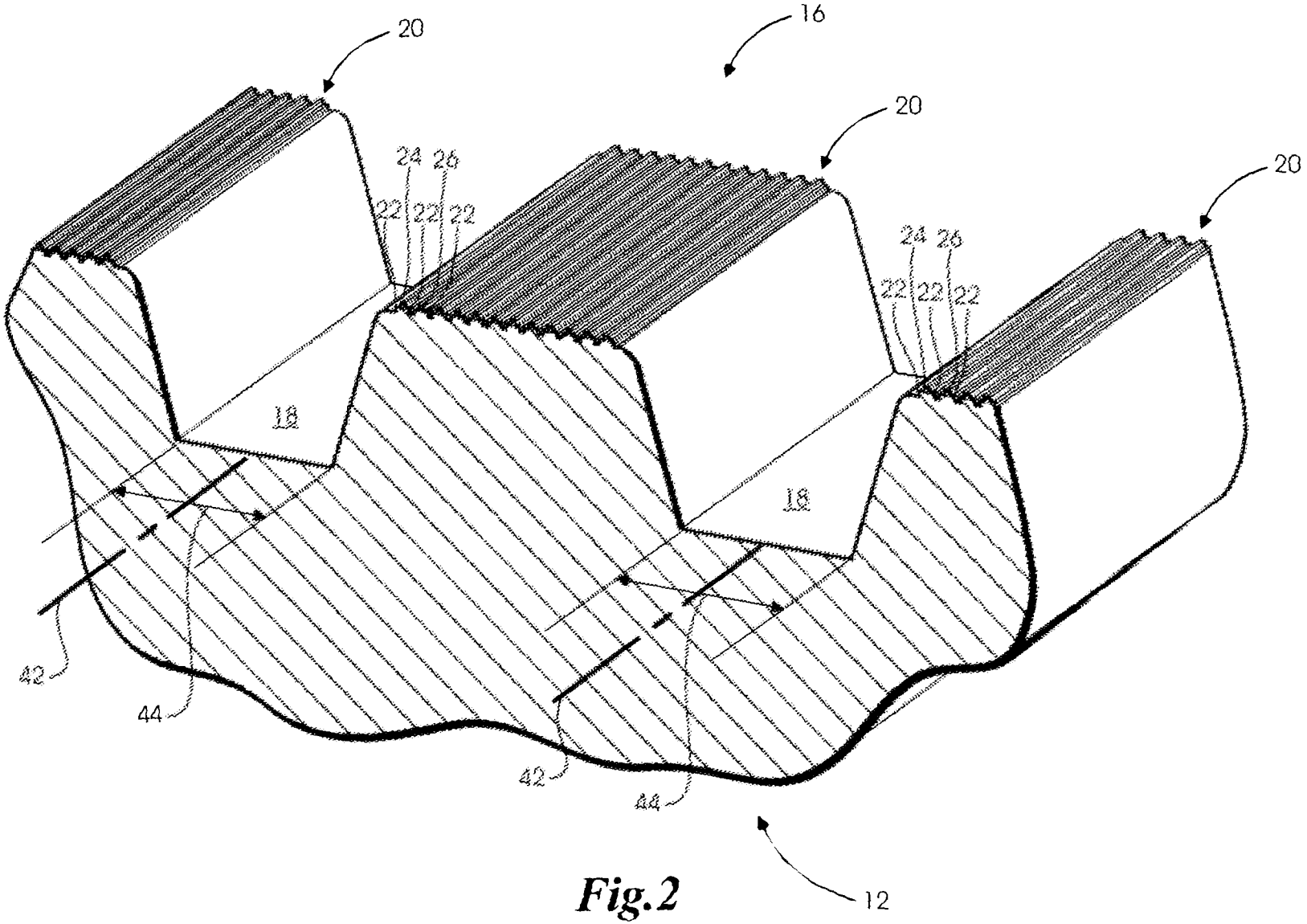
FIG. 2 is an enlarged partial perspective view of the golf club head of FIG. 1.

Referring also to FIG. 2, for example, the land portion 20 is associated with at least a first step portion or ridge 22 extending at a first elevation or level $E_1$, a second step portion or ridge 24 extending at a second elevation or level $E_2$, and a third step portion or ridge 26 extending at a third elevation or level $E_3$, all relative to one or more bottoms or base levels 26 of the channels 18. As used herein, the terms "top," "bottom," "front," "rear," "side," and other directional terms are not intended to require any particular orientation, but are instead used for purposes of description only. As explained below, the second and third step portions 24, 26 create a "double roughness" surface that can reduce the amount of friction between water or moisture and the metal surface, for example by creating a bubble of air between the water and the metal surface. This in turn may facilitate removing the water toward the channels 18 so that it can be filtered away, similar to tire treads.

In the illustrated embodiment, the first step portion 22 is defined by a first lateral portion 30 extending substantially parallel to one or more bottoms 28 of the channels 18 and a first upturned or vertical portion 32 extending upwardly and substantially perpendicular to one or more bottoms 28 of the channels 18. As such, the illustrated step portions 22 are each associated by an inverted "L" cross-sectional shape. Likewise, the second step portion 24 is defined by a second lateral portion 34 and a pair of second upturned portions 36, and the third step portion 26 is defined by a third lateral portion 38 and a pair of third upturned portions 40. In the illustrated embodiment, the first step portion 22 is abutting the second step portion 24 or the third step portion 26. In other embodiments, the first and second step portions 22, 24 or the first and third step portions 22, 26 may be separated by a slight gap.

In the illustrated embodiment, at least one of the channels 18 is associated with a longitudinal axis 42, and the second step portion 24 is recessed relative to the first step portion 22 toward a direction 44 substantially perpendicular to the longitudinal axis 42. Moreover, in the illustrated embodiment, the first step portion 22 extends substantially parallel to the second step portion 24. Furthermore, in the illustrated embodiment each step 22, 24, 26 extends substantially parallel to the channels 18. In other embodiments, the first step portion 22 may extend non-parallel to the second step portion 24. Moreover, at least one of the step portions 22, 24, 26 may extend non-parallel to the channels 18.

In the illustrated embodiment, the upturned portions 36, 40 of the second and third step portions 24, 26 are separated by the lateral and upturned portions 30, 32 of the first step portion 22. Moreover, in the illustrated embodiment, the third step portion 26 extends at substantially the same elevation $E_3$ as the second step portion 24, and the second and third step portions 24, 26 are of substantially congruent shapes from a side view. Although the illustrated embodiment includes 14 step portions in total extending at the elevation $E_2$ or $E_3$, other embodiments may include other numbers of step portions extending at the elevation $E_2$ or $E_3$. For example, the land portion 20 may include 2 or more, 3 or more, 4 or more, 5 or more, 6 or more, 7 or more, 8 or more, 9 or more, 10 or more, 11 or more, 12 or more, 13 or more, 14 or more, 15 or more, 20 or more, 25 or more, 30 or more, 40 or more, 50 or more, 60 or more, 70 or more, 80 or more, 90 or more, 100 or more, 110 or more, or 120 or more step portions extending at the elevation $E_2$ or $E_3$.

In the illustrated embodiment, the second elevation $E_2$ is higher than the first elevation $E_1$ relative to one or more bottoms or base levels 28 of the channels 18. In some embodiments, each step portion 22, 24, 26 is associated with a height of about 5 micrometers to about 50 micrometers. In some embodiments, each step portion 22, 24, 26 is associated with a height of about 5 micrometers or greater, about 10 micrometers or greater, about 15 micrometers or greater, about 20 micrometers or greater, about 25 micrometers or greater, about 30 micrometers or greater, about 35 micrometers or greater, about 40 micrometers or greater, or about 45 micrometers or greater. In further embodiments, each step portion 22, 24, 26 is associated with a height of about 50 micrometers or less, about 45 micrometers or less, about 40 micrometers or less, about 35 micrometers or less, about 30 micrometers or less, about 25 micrometers or less, about 20 micrometers or less, about 15 micrometers or less, or about 10 micrometers or less. This includes a height of about 5 micrometers to about 30 micrometers, or a height of about 20 micrometers. In some embodiments, each step portion 22, 24, 26 may be associated with substantially the same height. In other embodiments, the step portions 22, 24, 26 may be associated with individually varying heights.

Figure 3:
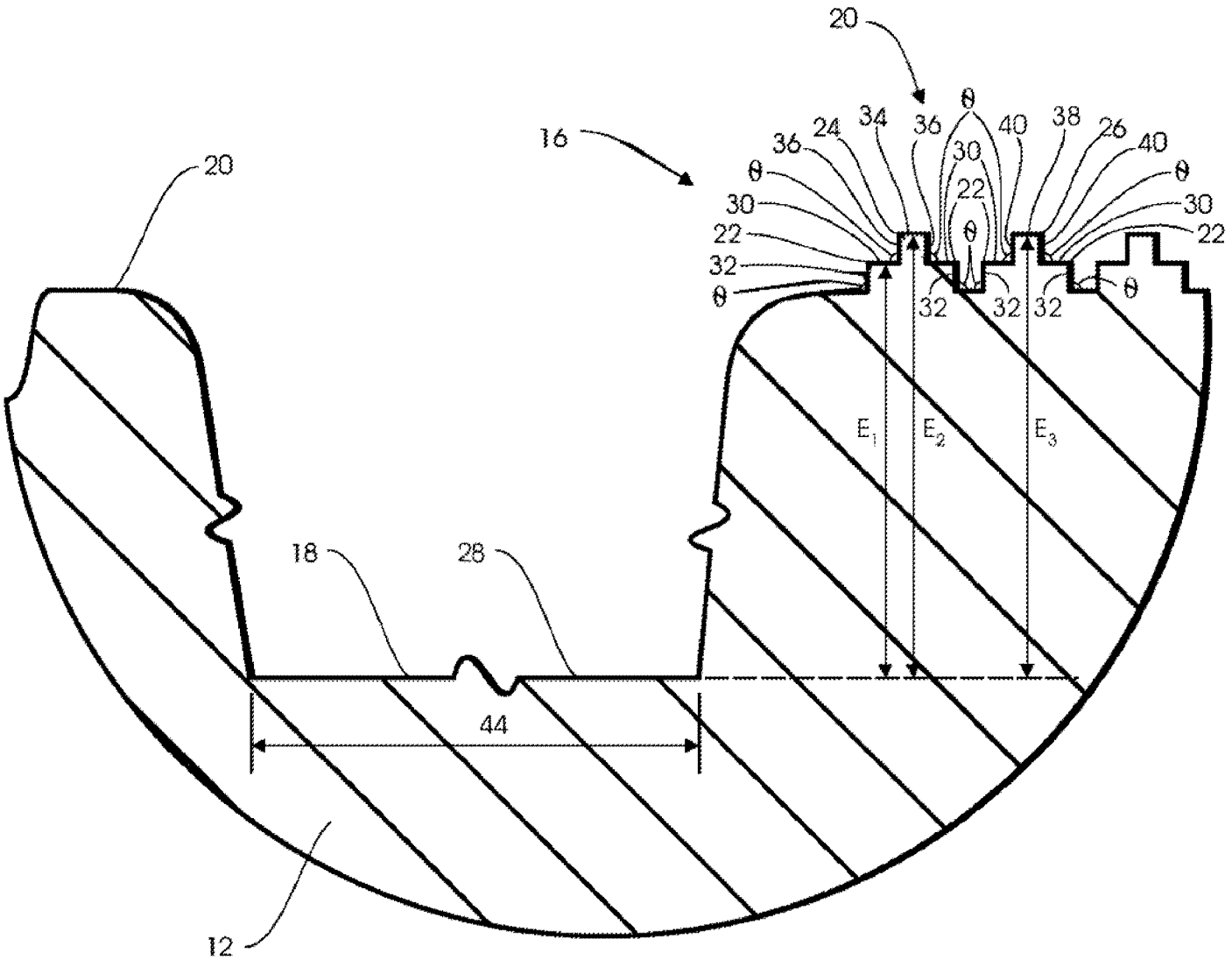
FIG. 3 is an enlarged partial side view of the golf club head of FIG. 1.

Referring also to FIG. 3, in some embodiments, each lateral portion 30, 34, 38 and upturned portion 32, 36, 40 of the step portions 22, 24, 26 may be associated with substantially the same dimensions, thereby creating a double-square step cross-sectional profile. For example, each lateral portion 30, 34, 38 and upturned portion 32, 36, 40 of the step portions 22, 24, 26 may be associated with a width or height of 10 micrometers, and approximately 120 step portions may fit on the land portion 20 extending between the channels 18. In other embodiments, each lateral portion 30, 34, 38 and upturned portion 32, 36, 40 of the step portions 22, 24, 26 may be associated with a width or height of 50 micrometers, and approximately 25 step portions may fit on the land portion 20 extending between the channels 18. In still other embodiments, each lateral portion 30, 34, 38 and upturned portion 32, 36, 40 of the step portions 22, 24, 26 may be associated with a width or height of other dimensions, including dimensions that may not create a double-square step cross-sectional profile. In further embodiments, other numbers of step portions may fit on the land portion 20 extending between the channels 18.

Figure 4:
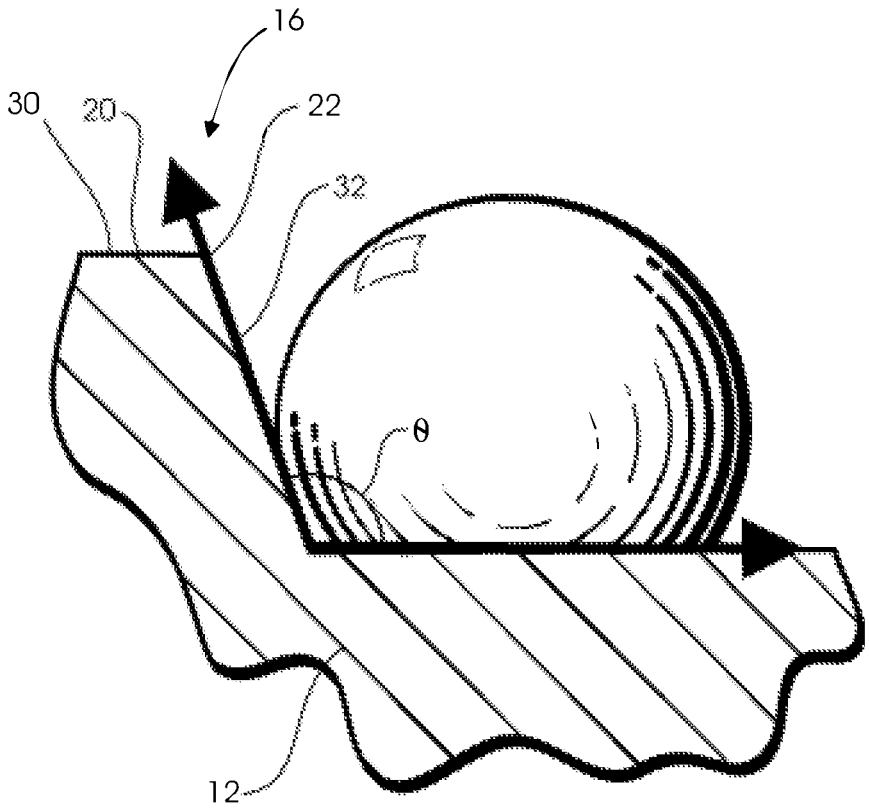
FIG. 4 is a schematic illustration of a water droplet contacting the golf club head of FIG. 1.

Referring also to FIG. 4, each step portion 22, 24, 26 is so dimensioned as to be associated with a substantially hydrophobic contact angle θ. Hydrophobicity or super-hydrophobicity as used herein includes definitions that are generally know in the material art, and can describe water-repelling property on material surfaces. The term "hydrophobic," as used herein, is inclusive of surfaces that are considered super-hydrophobic. Hydrophobicity or super-hydrophobicity may be observed in nature, such as on lotus leaf and other organic surfaces. Water droplets standing on these organic surfaces have been found to appear in a near-spherical shape. The near-spherical water droplets may roll off the surfaces easily. Generally speaking, a surface that makes a contact angle with water θ of less than about 90° may be considered hydrophilic. A surface that makes a contact angle with water θ of more than about 90° may be considered hydrophobic. A surface that makes a contact angle with water θ of more than about 150° may be considered super-hydrophobic. In some embodiments, the substantially hydrophobic contact angle θ is about 80° or greater. This includes contact angles θ of 85° or greater, 90° or greater, 95° or greater, 100° or greater, 105° or greater, 110° or greater, 115° or greater, 120° or greater, 125° or greater, 130° or greater, 135° or greater, 140° or greater, 145° or greater, 150° or greater, 155° or greater, 160° or greater, 165° or greater, 170° or greater, or 175° or greater.

Although hydrophobic or super-hydrophobic surfaces may be fabricated on metal surfaces by chemical methods such as acid etching, one of the drawbacks of such surfaces is that they are fragile and easily peeled off. Furthermore, hydrophobic or super-hydrophobic surfaces that are fabricated on metal surfaces by chemical methods may undesirably form spiked cones (e.g., more than 1 million cones/$cm^3$) with sharp points that minimize solid-liquid contact, and may increase the surface roughness above about 180 micro-inches or 5 micrometers and thereby over influencing the movement of the ball.

In some embodiments, each step portion 22, 24, 26 is associated with a surface roughness of about 5 micrometers or less. In further embodiments, each step portion 22, 24, 26 is associated with a surface roughness of about 4.9 micrometers or less, about 4.8 micrometers or less, about 4.7 micrometers or less, about 4.6 micrometers or less, about 4.5 micrometers or less, about 4.4 micrometers or less, about 4.3 micrometers or less, about 4.2 micrometers or less, about 4.1 micrometers or less, about 4.0 micrometers or less, about 3.9 micrometers or less, about 3.8 micrometers or less, about 3.7 micrometers or less, about 3.6 micrometers or less, about 3.5 micrometers or less, about 3.4 micrometers or less, about 3.3 micrometers or less, about 3.2 micrometers or less, about 3.1 micrometers or less, about 3.0 micrometers or less, about 2.9 micrometers or less, about 2.8 micrometers or less, about 2.7 micrometers or less, about 2.6 micrometers or less, about 2.5 micrometers or less, about 2.4 micrometers or less, about 2.3 micrometers or less, about 2.2 micrometers or less, about 2.1 micrometers or less, about 2.0 micrometers or less, about 1.9 micrometers or less, about 1.8 micrometers or less, about 1.7 micrometers or less, about 1.6 micrometers or less, about 1.5 micrometers or less, about 1.4 micrometers or less, about 1.3 micrometers or less, about 1.2 micrometers or less, about 1.1 micrometers or less, about 1.0 micrometer or less, about 0.9 micrometers or less, about 0.8 micrometers or less, about 0.7 micrometers or less, about 0.6 micrometers or less, about 0.5 micrometers or less, about 0.4 micrometers or less, about 0.3 micrometers or less, about 0.2 micrometers or less, or about 0.1 micrometer or less.

Moreover, in some embodiments, the step portions 22, 24, 26 may not influence the movement of the ball, for example, the step portions 22, 24, 26 may not impart more friction/spin to the ball. Rather, the step portions 22, 24, 26 may facilitate removing water to the channels 18 so that there is less variability between dry and wet conditions, e.g., for imparting spin to the ball. Moreover, by repelling water to the channels 18, corrosion of the club head 12 may be mitigated. Thus, in some embodiments, each step portion 22, 24, 26 may have a double-square step cross-sectional profile and/or surface roughness of about 5 micrometers or less rather than a single step portion configuration, which may have a surface roughness greater than 5 micrometers, as discussed above.

In some embodiments, at least one of the step portions 22, 24, 26 are formed by laser ablation or removal. Laser or other suitable high energy sources can be used as a flexible micro-fabrication tool, allowing precise control over requisite dimensions of micro-structures and fabricating hydrophobic or super-hydrophobic surfaces over an area without necessarily requiring further chemical processes. Especially, UV laser at a shorter laser wavelength allows to achieve a small focused spot size than other pulsed lasers, which can be more suitable for micro-fabrication. As beam intensity is increased, the material begins to evaporate or ablate. Ablation may start when the temperature of the surface of the material exceeds its evaporation temperature. Increases in the laser intensity may lead to material removal by melt ejection and vaporization. In short, rapid heating of the substrate melts, vaporizes, and then ionizes the vapor at least in part, which then leaves the surface of the substrate.

In some embodiments, a $CO_2$-type laser or an Nd-YAG-type laser may be employed at power levels ranging from 500 W to 4000 W to micro-machine the step portions 22, 24, 26. The pulse repetition rate or frequency may be fixed at 30 kHz with a pulse duration or dwell time (full width half maximum) of 20 ns. The laser spot size or width may be in a range of about 0.01 mm to about 0.5 mm. This includes a laser spot size or width of about 0.01 mm or more, about 0.02 mm or more, about 0.03 mm or more, about 0.04 mm or more, about 0.05 mm or more, about 0.06 mm or more, about 0.07 mm or more, about 0.08 mm or more, about 0.09 mm or more, about 0.10 mm or more, about 0.20 mm or more, about 0.30 mm or more, or about 0.40 mm or more. In some embodiments, the spot size or width may be about 0.50 mm or less, about 0.40 mm or less, about 0.30 mm or less, about 0.20 mm or less, about 0.10 mm or less, about 0.09 mm or less, about 0.08 mm or less, about 0.07 mm or less, about 0.06 mm or less, about 0.05 mm or less, about 0.04 mm or less, about 0.03 mm or less, or about 0.02 mm or less. In some embodiments, the laser spot size or width may be about 0.04 mm or 0.25 mm. The laser beam may be linked to a computer-aided design (CAD) drawing, and may directly write designed patterns on the metal substrates by software programming through a PC graphic interface and.

In some embodiments, each step portion 22, 24, 26 is substantially free of a polymer coating such as polypropylene, co-polyesters, and polytetrafluoroethylene. For example, the illustrated step portions 22, 24, 26 may be formed of a monolithic material or metal without applying a polymer coating to the ball striking surface 16.

It should be understood from the foregoing that, while particular embodiments have been illustrated and described, various modifications can be made without departing from the spirit and scope of the disclosure as will be apparent to those skilled in the art. Such changes and modifications are within the scope and teachings of this disclosure as defined in the claims appended hereto.

The invention claimed is:

1. A golf club head comprising:

a ball-striking face; and at least two channels formed in the ball-striking face;

wherein the channels are separated by a land portion of the ball-striking face extending therebetween, wherein each channel comprises a width of approximately 0.030 inch and a depth of approximately 0.018 inch;

wherein the land portion is associated with at least a first step portion extending at a first elevation and a second step portion extending at a second elevation, the second elevation being higher than the first elevation relative to a bottom of the channels;

wherein the first step portion is defined by a first lateral portion extending substantially parallel to one or more bottoms of the channels and a first upturned or vertical portion extending upwardly and substantially perpendicular to one or more bottoms of the channels and;

the second step portion is defined by a second lateral portion and a pair of second perpendicular upturned portions;

and wherein each of the first and second step portions is so dimensioned as to be associated with a substantially hydrophobic contact angle;

wherein the substantially hydrophobic contact angle is about 80 degrees or greater.

2. The golf club head of claim 1; wherein the first step portion extends substantially parallel to the second step portion.

3. The golf club head of claim 1; wherein at least one of the first and second step portions extends substantially parallel to at least one of the channels.

4. The golf club head of claim 1; wherein each of the first and second step portions is substantially free of a polymer coating.

5. The golf club head of claim 1; wherein each of the first and second step portions is associated with at least one of a height being about 5 micrometers to about 50 micrometers;

wherein the first step portion is parallel to a bottom of a channel and the second step portion is parallel to the bottom of a channel.

6. The golf club head of claim 5; wherein the first step portion height varies from the second step portion height.

7. The golf club head of claim 1; further comprising a third step portion;

wherein the second and third step portions are separated by the first step portion extending therebetween.

8. The golf club head of claim 7; wherein a second step portion height varies from a third step portion height; and wherein a first step portion height varies from the third step portion height.

9. The golf club head of claim 1; wherein at least one of the channels is associated with a longitudinal axis, and wherein the second step portion is recessed relative to the first step portion toward a direction substantially perpendicular to the longitudinal axis.

10. The golf club head of claim 1; wherein the first step portion is abutting the second step portion.

11. The golf club head of claim 1; wherein each of the first and second step portions is associated with a surface roughness of about 5 micrometers or less.

12. The golf club head of claim 1; wherein at least one of the first and second step portions is formed by laser ablation.

13. The golf club head of claim 11; wherein the laser ablation pulse repetition rate is fixed a 30 kHz;

wherein a laser pulse duration is 20 ns; and wherein a laser spot size comprises a range of 0.01 mm to 0.5 mm.

14. A golf club head comprising:

a ball-striking face; and at least two channels formed in the ball-striking face;

wherein the channels are separated by a land portion of the ball-striking face extending therebetween, wherein each channel comprises a width of approximately 0.030 inch and a depth of approximately 0.018 inch;

wherein the channels are separated by a land portion of the ball-striking face extending therebetween, wherein the land portion is associated with at least a first step portion extending at a first elevation, a second step portion extending at a second elevation, the second elevation being higher than the first elevation relative to a bottom of the channels, and a third step portion extending at substantially the same elevation as the second step portion;

wherein the first step portion is defined by a first lateral portion extending substantially parallel to one or more bottoms of the channels and a first upturned or vertical portion extending upwardly and substantially perpendicular to one or more bottoms of the channels and, the second step portion is defined by a second lateral portion and a pair of second perpendicular upturned portions;

wherein the first step portion abuts the second and third step portion; and wherein each of the first, second, and third step portions is so dimensioned as to be associated with a substantially hydrophobic contact angle;

wherein the substantially hydrophobic contact angle is about 80 degrees or greater.

15. The golf club head of claim 14, wherein each of the first, second, and third step portions is associated with at least one of a height being about 5 micrometers to about 50 micrometers, a height being about 5 micrometers to about 30 micrometers, or a height being about 20 micrometers.

16. The golf club head of claim 15; wherein a first step height varies from a third step height; and wherein a second step height varies from the third step height.

17. The golf club head of claim 14, wherein each of the first, second, and third step portions is associated with a surface roughness of about 5 micrometers or less.

18. The golf club head of claim 14, wherein at least one of the first, second, and third step portions is formed by laser ablation.

19. The golf club head of claim 18;

wherein the laser ablation pulse repetition rate is fixed at 30 kHz;

wherein a laser pulse duration is 20 ns; and wherein a laser spot size comprises a range of 0.01 mm to 0.5 mm.

* * * * *